United States Patent [19]

Bar

[11] Patent Number: 4,716,662

[45] Date of Patent: Jan. 5, 1988

[54] INSOLE AND METHOD FOR PRODUCING SAME

[76] Inventor: Aharon Bar, 8 Tel-Mane Street, Haifa 34363, Israel

[21] Appl. No.: 725,581

[22] Filed: Apr. 22, 1985

[30] Foreign Application Priority Data

Apr. 22, 1984 [IL] Israel ..... 71616
Feb. 11, 1985 [IL] Israel ..... 74294

[51] Int. Cl.[4] ..... A43B 13/40; B29C 67/22

[52] U.S. Cl. ..... 36/44; 12/146 B; 36/91; 264/46.4; 264/46.5; 264/161; 264/223; 264/244

[58] Field of Search ..... 264/244, 223, 46.4, 264/46.5, 161; 12/146 B; 36/44, 71, 43, 91

[56] References Cited

U.S. PATENT DOCUMENTS

| | | | |
|---|---|---|---|
| 1,955,720 | 4/1934 | Rollmann | 264/244 X |
| 2,651,118 | 9/1953 | Root | 264/244 X |
| 2,917,782 | 12/1959 | Goldwag | 264/223 |
| 2,962,738 | 12/1960 | Andrade et al. | 264/244 X |
| 3,002,230 | 10/1961 | Stewart | 264/244 X |
| 3,021,572 | 2/1962 | Smith, Jr. | 264/244 X |
| 3,121,431 | 2/1964 | Rosenhaft | 264/223 X |
| 3,170,250 | 2/1965 | Scholl | 36/44 |
| 3,320,347 | 5/1967 | Greenawalt | 264/223 |
| 3,398,221 | 8/1968 | Sherman et al. | 264/223 |
| 3,416,245 | 12/1968 | Ferreira | 36/44 |
| 3,530,489 | 9/1970 | Appleton | 36/44 |
| 3,555,709 | 1/1971 | Raffaelli, Sr. | 36/44 |
| 3,766,669 | 10/1973 | Pearsall | 36/43 |
| 3,814,781 | 6/1974 | Ola et al. | 264/244 X |
| 3,895,405 | 7/1975 | Edwards | 12/146 M |
| 3,968,577 | 7/1976 | Jackson | 36/43 |
| 4,020,570 | 5/1977 | Shames | 36/44 |
| 4,385,024 | 5/1983 | Tansill | 264/223 |
| 4,450,122 | 5/1984 | Gallina | 264/223 |

FOREIGN PATENT DOCUMENTS

| | | |
|---|---|---|
| 2141167 | 3/1972 | Fed. Rep. of Germany . |
| 2446483 | 4/1976 | Fed. Rep. of Germany . |
| 2721443 | 11/1978 | Fed. Rep. of Germany . |
| 2903416 | 7/1980 | Fed. Rep. of Germany . |
| 3004928 | 8/1981 | Fed. Rep. of Germany . |
| 2649761 | 4/1982 | Fed. Rep. of Germany . |
| 3037108 | 5/1982 | Fed. Rep. of Germany . |
| 3113295 | 10/1982 | Fed. Rep. of Germany . |
| 648 | 5/1935 | Israel . |
| 5603 | 10/1950 | Israel . |

OTHER PUBLICATIONS

R. G. S. Platts, S. Knight, & I. Jakins, "Shoe Inserts for Small Deformed Feet", *Prosthetics & Orthodics Interntl.* 1982, vol. 6, pp. 108–110.

*Primary Examiner*—Philip Anderson
*Attorney, Agent, or Firm*—Browdy and Neimark

[57] ABSTRACT

A method for casting in situ an insole on a foot comprising the steps of preparing a mold defining an open top recess, providing a casting material in the recess, placing the foot inside the recess at a predetermined angle and position relative to the mold, engaging the casting material by the plantar surface of the foot, permitting the casting material to conform to the shape of the plantar surface of the foot, and permitting the casting material to harden.

7 Claims, 23 Drawing Figures

INSOLE AND METHOD FOR PRODUCING SAME

FIELD OF THE INVENTION

The present invention relates to insoles or inserts for shoes and a method of producing them.

BACKGROUND OF THE INVENTION

An insole is an element inserted between a shoe and the foot to reduce local pressures in sensitive spots on the plantar surface of the foot so as to prevent or reduce pain and future damage to the foot and to the locomotor system. This is accomplished by fixing the foot in a certain position and orientation relative to the shoe, and by controlling the shape of the insole/foot interfacial surface.

Several types of insoles are widely marketed. For certain problems, a standard, pre-cut insole suffices which can be mass produced in various shoe sizes and fit into conventional shoes. However, in certain cases individually tailored shoe inserts which are shaped to the individual foot, are required. Such inserts are presently made by a process which is both laborious and time consuming. A plaster cast is taken of the affected foot and, using this cast, an insert of the proper size and shape is built by hand and fit into the shoe.

Two other methods disclosed in the literature, which are less time consuming than this method, are based on molding an insole inside the shoe. The first is a method of producing inserts for ordinary shop-bought or standard "deep shoes", disclosed by R. G. S. Platts, S. Knight and I. Jakins in an article entitled "Shoe inserts for small deformed feet", *Prosthetics And Orthotics International,* 1982, Vol. 6, pp. 108–110. This method involves molding the insert in the shoe either using the foot itself or a positive cast of the foot. The method includes preparing a shoe-shaped "polythene" bag, which is out, sealed and heat shrunk onto a last of approximately appropriate size for the shoe, and preparing an insole base for stiffening. The insole base is placed in the polythene shoe bag and both are placed in the shoe. If using the patient's foot directly, the foot is clothed in stockinette and covered with a shaped sock made of Ambla P072 having a polyurethane film which is painted with a release agent where adhesion to the foam is not required. If using a cast, the cast is covered with a thin latex sheath.

The components of a flexible self-generating polyurethane foam are mixed and quickly poured into the polythene bag in the shoe. The foot or cast is placed in the shoe and the correct attitude is maintained for a further two minutes until the foam hardens. The patient should bear weight on the foot.

Once the foam has hardened, the foot and the polythene bag are removed from the shoe and the insert is trimmed as necessary. A layer of performed polyurethane foam is added to complete the insert.

It is a disadvantage of this method that the uncontrolled pressure created within the shoe during molding causes a change in foot shape and placement relative to the shoe.

The second method of preparing an insole inside the shoe is disclosed in U.S. Pat. No. 3,895,405. This method comprises placing a flexible foam insole member into a shoe, heating the insole to a temperature sufficient to cause the foam to lose some of its resiliency, placing a foot in the shoe before the insole regains its resiliency, and taking steps with the foot in the shoe until the insole regains its resiliency.

Both of these methods suffer from the difficulty of fixing the position of the foot and its joints while in the shoe. Therefore, it is not possible to obtain the desired height and precise shape of the insole by the molding process itself, thus requiring additional steps of trimming or adding layers to the insole, which lengthen the process of insole production. Furthermore, since both of these methods are based on weight bearing during the molding process, they cannot be applied to those corrective concepts which are based on non-weight bearing while producing an insole.

SUMMARY OF THE INVENTION

It is an object of the present invention to provide a simple and fast method for production of shoe insoles which permits the precise control of the insole being produced.

There is thus provided in accordance with the present invention a method for casting in situ an insole on a foot comprising the steps of preparing a mold defining an open top recess, providing a casting material in the recess, placing the foot inside the recess at a predetermined angle and position relative to the mold, engaging the casting material by the plantar surface of the foot, permitting the casting material to conform to the shape of the plantar surface of the foot, and permitting the casting material to harden.

According to a preferred embodiment of the invention, there is provided a method for producing an insole for a foot including the following steps. A mold is prepared defining an open top recess which is preferably slightly larger than the foot and which preferably is shaped to conform to the inner base of a shoe. A foamable casting material in its liquid state is poured into the recess and, preferably, and insulating flexible layer is placed on the top of the mold. The flexible layer and the casting material in the recess are engaged by the foot at a predetermined angle and position, and the casting material is permitted to foam and to harden.

According to a preferred embodiment, the mold is coated with a release agent before the casting material is poured into it. Further according to a preferred embodiment, a reinforcing flexible member is placed in the recess before the casting material is poured into it.

According to a preferred embodiment, the method further includes the step of restraining the foot in the predetermined angle and position during the molding process.

There is further provided in accordance with the present invention a method for producing an insole for a foot including the following steps. A layer of a thermoplastic cellular material which undergoes plastic deformation under low pressure is placed in the recess of a mold substantially identical to that used in the method of the previously described embodiment and, preferably, an insulating flexible layer is placed on the top of the mold. The thermoplastic layer is heated until it becomes plastic deformable before and/or after placement in the mold. Preferably, a flexible heating layer is placed between the thermoplastic and insulating layers. The foot is pressed onto the layers until the thermoplastic member conforms to the plantar surface of the foot, and until the foot reaches the desired depth and attitude relative to the mold. Then the thermoplastic member is permitted to cool and, when it has regained its resiliency, the foot is removed and the insole is completed.

There is still further provided in accordance with the present invention an insole cast according to any of the above methods. There is additionally provided a corrective shoe including an insole cast according to any of the above methods.

There is additionally provided in accordance with the present invention apparatus for in situ casting an insole on the foot comprising an open top mold defining a foot shaped recess. In accordance with a preferred embodiment, the mold defines at least one overflow outlet.

Further according to a preferred embodiment, the apparatus further includes a layer of insulating material covering the mold. Still further according to a preferred embodiment, the apparatus includes foot restraining means for restraining a foot in a predetermined attitude relative to the mold.

Additionally in accordance with an embodiment of the present invention the mold is formed to define recesses in the insole to enable transverse compression thereof, so as to accomodate varying shoe widths.

Further in accordance with an embodiment of the present invention, the insole is formed with at least portions thereof of thermoplastic material to match the particular shape of a foot.

BRIEF DESCRIPTION OF THE DRAWINGS

The apparatus and method of the present invention will be further understood and appreciated from the following detailed description taken in conjunction with the drawings in which.

DETAILED DESCRIPTION OF THE INVENTION

Figure 1:
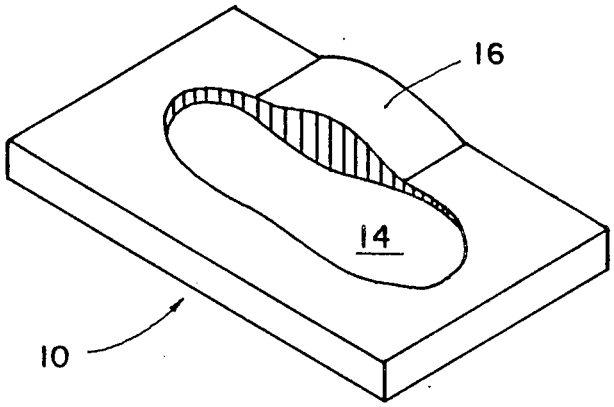
FIG. 1 is a perspective illustration of apparatus for producing an insole constructed and operative in accordance with an embodiment of the present invention.

With reference to FIG. 1 there is shown a mold 10 for casting in situ on a foot an insole for insertion into a shoe constructed and operative in accordance with an embodiment of the present invention. The mold 10 defines an open top recess 14 of suitable size and shape to accomodate a foot. The shape of recess 14 preferably approximates a slightly enlarged version of the projected area of the foot.

According to a preferred embodiment of the invention, the recess of the mold defines the identical shape of the shoe into which the insole is to be fitted. It is a particular feature of the insole produced by this embodiment of the invention that the only treatment required after molding is trimming any overflow material from the periphery of the insole before insertion thereof into the shoe. Such immediate use is not possible with insoles produced by prior art methods which usually require the addition of layers to the insole, or additional hand shaping and cutting.

Additional structural support in the form of a raised support element 16 may be provided at a portion of recess 14 which will be adjacent the medial arch of the foot. Support element 16 serves to permit the formation of an insole of greater height in the medial arch as compared with the lateral arch region. Support element 16 is preferably integrally formed with mold 10.

Figure 12:
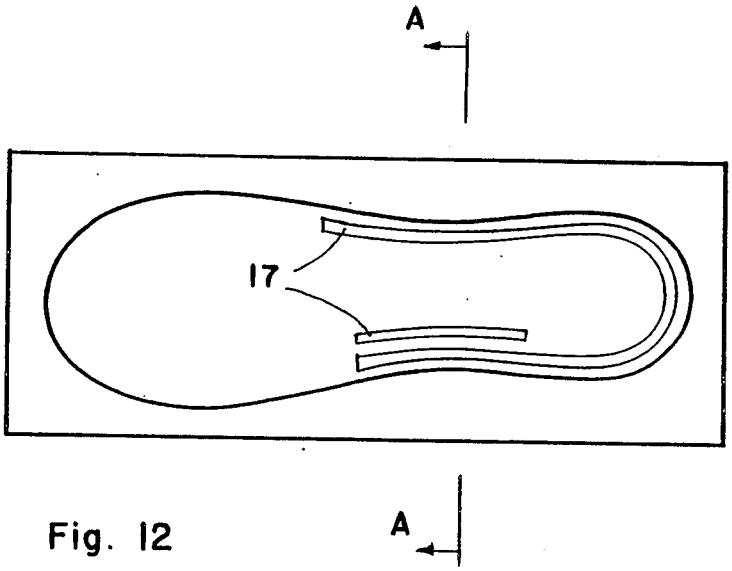
FIG. 12 is a plan view illustration of a mold for producing an insole having recesses in the base thereof in accordance with an embodiment of the present invention.
Figure 13:
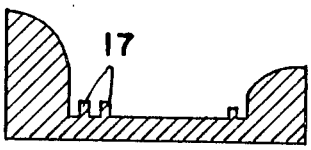
FIG. 13 is a sectional illustration of the mold of FIG. 12, taken along the lines A—A therein.

According to a preferred embodiment of the present invention, the mold 10 may be constructed as illustrated in FIGS. 12 and 13, to include protrusions 17 extending upwardly from the base of the mold. Preferably protrusions 17 are elongated and are arranged to extend along the side of the mold adjacent the edge thereof. These protrusions define corresponding recesses 18 in the base of the insole 19 formed by the mold. The provision of these recesses, enables the insole to be compressed transversely to securely fit within shoes of various widths.

Mold 10 may be constructed of any conventional mold material which is compatible with the casting material. The mold may be made, for example, with an upper surface of rubber or polyethylene, when the casting material is polyurethane. Preferably, the mold is constructed of material to which the casting material will not stick. Alternatively or in addition, the mold may be coated with a release agent before providing the casting material. Any conventional release agent may be utilized, such as a coating of wax or other material to prevent adhesion.

Figure 2:
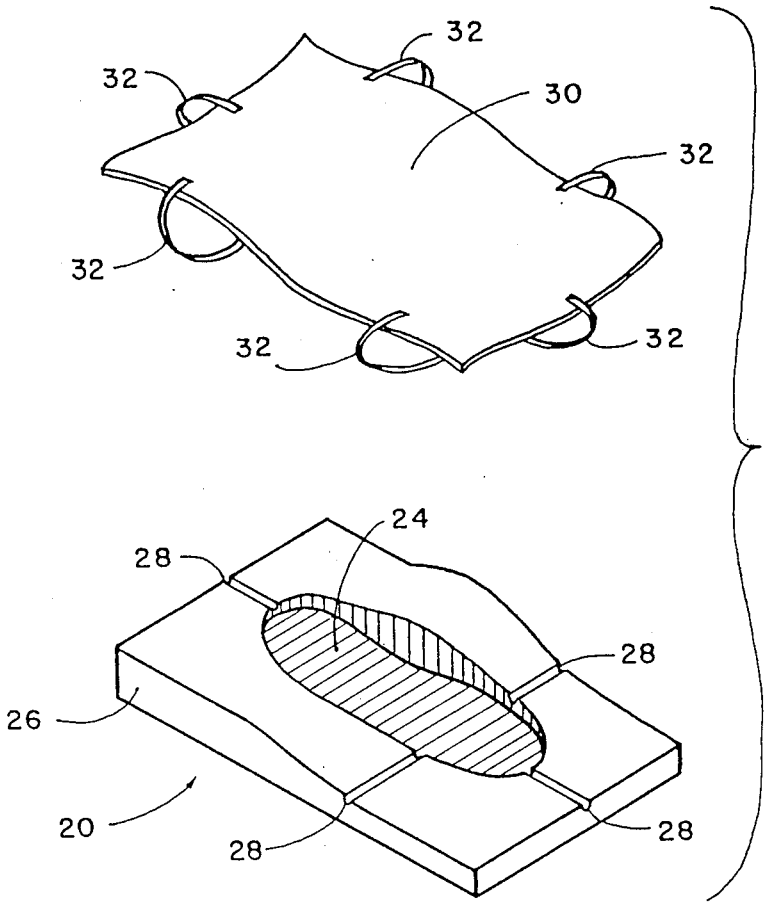
FIG. 2 illustrates apparatus for producing an insole constructed and operative in accordance with an alternate embodiment of the present invention in an exploded perspective view.
Figure 3:
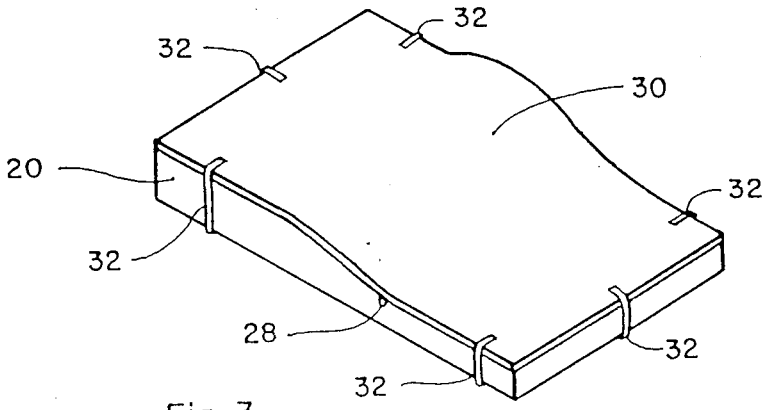
FIG. 3 is a perspective illustration of the apparatus of FIG. 2 in a non-exploded orientation for use.

Referring now to FIGS. 2 and 3, there is shown a mold for casting an insole for the right foot constructed and operative in accordance with an alternate embodiment of the present invention in respective exploded and non-exploded views. The mold, generally designated 20, defines an open top recess 24. Mold 20 defines a deeper portion 26, in this case the rear portion of the mold, to provide greater depth at the heel than at the toe. The provision of a deeper portion of the mold permits the production of an insole having a heel higher than the toe portion, as required by the particular problem of the foot, without the necessity for adding an additional heel or lift at a later stage, as required by the prior art.

Mold 20 may also define a plurality of overflow grooves 28. Grooves 28 serve as casting sprues to permit the overflow of casting material from the recess 24 during the casting process. This action will be explained in further detail hereinbelow.

An intermediate layer of flexible material 30 may additionally be provided on top of mold 20. Intermediate layer 30 serves as an insulating layer between the casting material and the foot. It acts both to protect the foot from the heat of the casting material and to prevent the casting material from sticking to the skin. It will be appreciated that flexible member 30 must be flexible enough to permit the foot to enter the recess and to permit the casting material within recess 24 to take on the shape of the plantar surface of the foot. Its flexibility and thickness will determine the degree of conformity between the upper surface of the insole and the plantar surface of the foot.

Flexible layer 30 may comprise leather, fabric, foam rubber, polyurethane foam or any other insulative material having the necessary flexibility and which is compatible with the casting material yet which is not adversely affected by the temperature of the casting. According to a preferred embodiment, flexible layer 30 self-bonds to the casting material, thereby becoming the integral upper surface of the insole. Intermediate layer 30 may simply be placed on top of mold 22 or it may be fixed in place on the mold as by stretch clamp bands 32, nails, screws or any other conventional retaining means.

Alternatively, insulating layer 30 may be provided in the form of a sock-like covering which is worn on the foot during casting.

Figure 4:
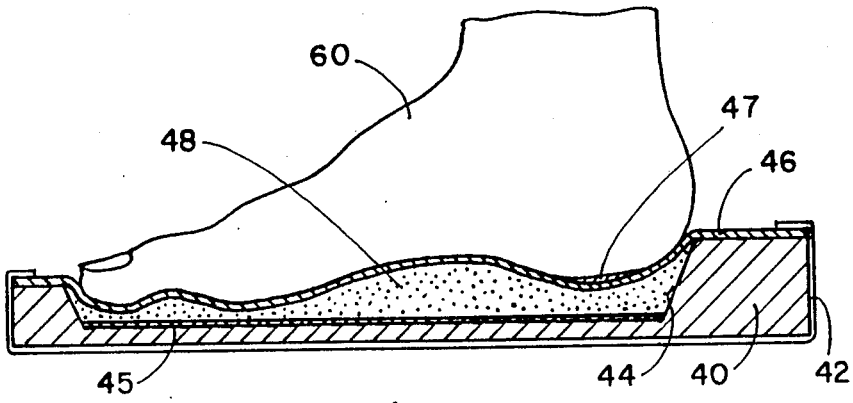
FIGS. 4, 5 and 6 illustrate the steps of a method for producing an insole in accordance with an embodiment of the present invention, FIG. 4 being a side sectional view during molding, FIG. 5 being a side sectional view of the insole before trimming, and FIG. 6 being a perspective view of the final insole.
Figure 5:
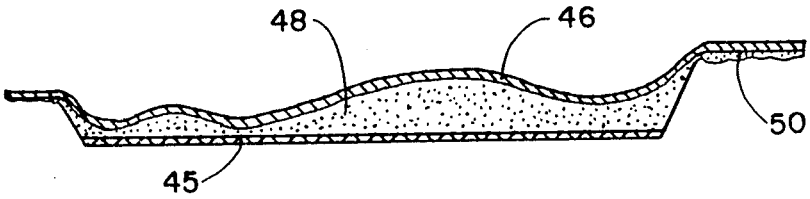

The method of producing an insole according to one preferred embodiment of the present invention will now be described with reference to FIGS. 4, 5 and 6. There is shown in FIG. 4 a sectional view of a mold 40 defining an open top recess 44. If desired, mold 40 is coated with a release agent to prevent adhesion of casting material to it. An optional reinforcing layer 45 may be placed within recess 44 for reinforcing the molded insole. Reinforcing layer 45 may comprise any material having the following characteristics: it bonds to the casting material during the molding process; it has good tensile strength; and it has low flexural stiffness. Suitable materials include canvas, woven fiberglas and woven carbon filaments.

Figure 15:
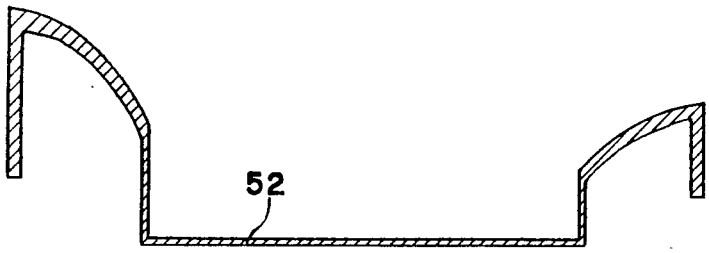
FIGS. 15, 16 and 17 are sectional illustrations of a preformed bottom layer of an insole, a mold corresponding thereto, and the preformed bottom layer positioned in the mold, respectively.
Figure 16:
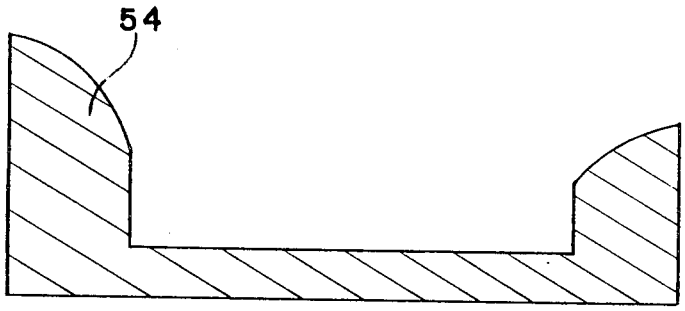
Figure 17:
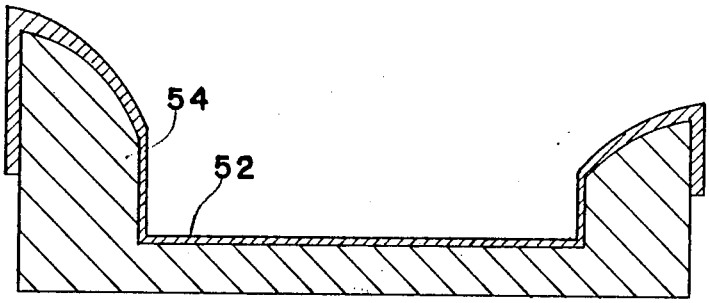

According to an alternative embodiment of the invention, a preformed reinforcing layer may be employed. Such a reinforcing layer is shown in FIGS. 15–17 and indicated by reference numeral 52. It is seen that the preformed reinforcing layer may be of non-uniform thickness and is normally formed to extend over the edges of the mold 54. After the insole is formed, the edges of the reinforcing layer which extend beyond the insole are simply trimmed. This construction has the advantage that the molding material is prevented from engagement with the mold and thus problems of release are avoided.

Figure 14:
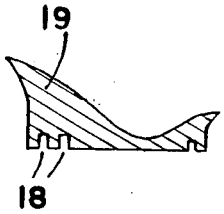
FIG. 14 is a sectional illustration of an insole produced from the mold of FIG. 12 at a location corresponding to lines A—A in FIG. 12.
Figure 18:
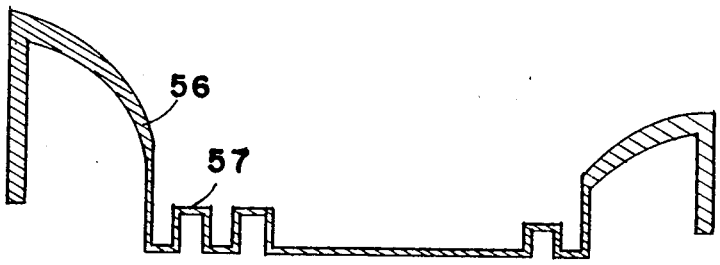
FIGS. 18, 19, and 20 are sectional illustrations of a preformed bottom layer of an insole having recesses at its base, a mold corresponding thereto and the preformed bottom layer positioned in the mold, respectively.
Figure 19:
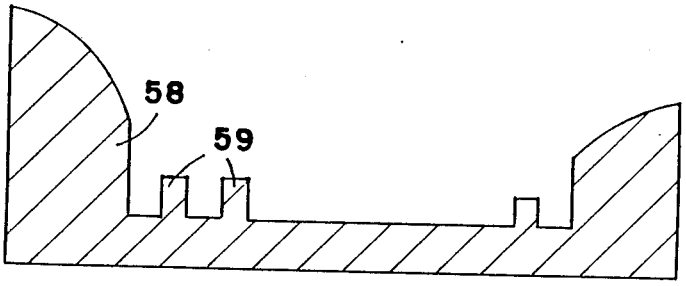
Figure 20:
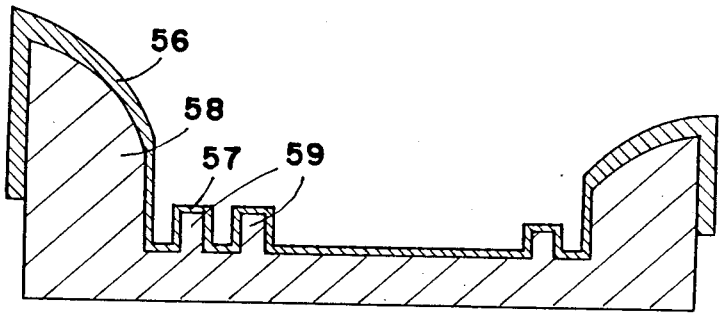

FIGS. 18–20 illustrate an alternative embodiment of the reinforcing layer. Here there is provided a reinforcing layer 56 having formed in the base thereof protrusions 57 in order to provide an insole with recesses as described in connection with FIGS. 12–14. The reinforcing layer 56 corresponds in shape to that of a mold 58 having protrusions 59.

Before actual casting is begun, the foot is examined and surface contouring may be added anywhere on the foot, such as a patch 47, to form local recesses in the finished insole. These recesses serve to release local pressure or load on a portion of the foot by the finished insole.

An intermediate layer of insulating material 46 is preferably provided on the mold, covering the recess 44. Insulating layer 46 may be retained in place as by stretch clamp bands 42. A casting material 48, comprising a foamable material in its liquid state, is introduced into recess 44. Casting material 48 may be introduced before intermediate layer 46 is placed on the mold, or it may be introduced afterwards via an inlet channel in the mold (not shown).

Casting material 48 may comprise any polymerizable material which is mixed or activated in a liquid state and which foams upon polymerization and hardens at room temperature to a solid foamed state. Polyurethane foam is particularly useful in this embodiment of the present invention as the casting material.

As soon as the casting material has been introduced into the recess, and intermediate layer 46 placed thereover, the plantar surface of the foot 60 is brought into engagement therewith and pressed into the recess. The foot 60 is retained at the desired angle and position relative to the mold for several minutes during which the casting material hardens. In the case of polyurethane, the mixture undergoes polymerization and foaming. This causes the casting material to expand to fill the space between recess 44 or reinforcing layer 45, if it exists, and insulating layer 46 and to press against the foot, thus conforming to the lower surface of the foot. Engagement of the foot with the casting material may be accomplished either by bringing the foot into engagement with the casting material in the mold, or by raising the mold into engagement with the foot. In any case, casting is preferably accomplished while the patient is not standing on the foot, except in those cases where weight bearing is necessary to the proper formation of the insole.

Figure 22:
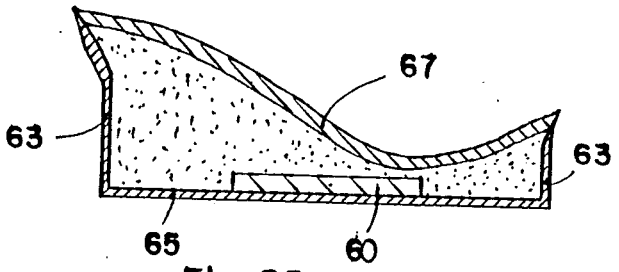
FIGS. 22 and 23 are respective sectional illustrations of an insole produced from the apparatus of FIG. 21, taken along lines A—A and B—B defined in FIG. 21.
Figure 23:
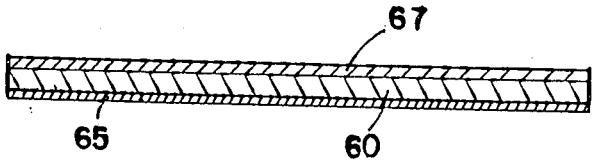
Figure 21:
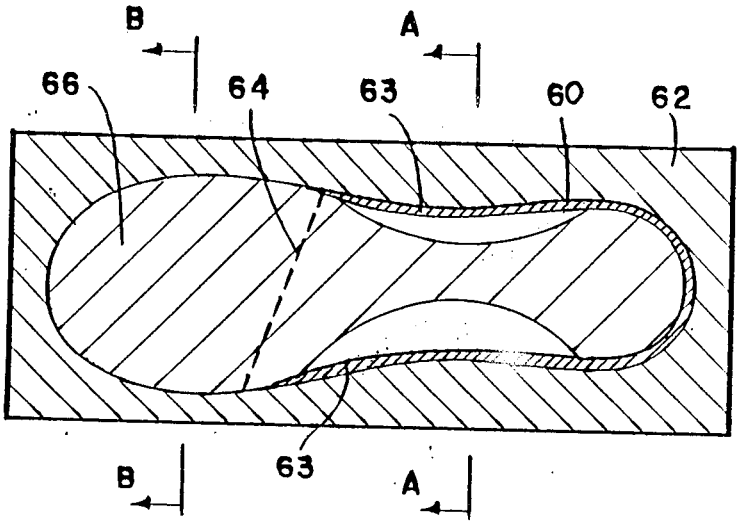
FIG. 21 illustrates a mold for an insole having located therewithin a a preformed bottom layer and a body of thermoplastic material.

According to an alternative embodiment of the present invention, a preformed base member of a thermoplastic material such as ethyl vinyl acetate may be inserted into the mold before the molding material is added to fill the mold. Reference is made in this connection to FIGS. 20–22. As seen in these illustrations, a reinforcing layer 60 is located in a mold 62. The reinforcing layer 60 is formed with side edge portions 63 extending up to the region of the metatarsals, indicated by dashed line 64. Forward of dashed line 64, the reinforcing layer 60 includes only a bottom portion 65.

There is placed on reinforcing layer 60 a preformed layer 66 or thermoplastic material, such as ethyl vinyl acetate, typically of thickness 2–7 mm. It is noted that preformed layer 66 is configured to completely fill the width of the mold within the reinforcing layer 60 at the forward and rear portions thereof but not in the central portion, which corresponds to the arch. At the central portion the preformed thermoplastic layer is tapered.

Forward of dashed line 64, a top insulating layer 67 is bonded directly onto preformed layer 66. Rearward of dashed line 64, molding material is used to fill the mold, but is restricted from the region forward of dashed line 64. In the central region, the molding material fills the mold alongside the preformed thermoplastic layer and thereabove and is covered by insulating layer 67. It may thus be appreciated that at the central region corresponding to the arch, the foot is supported directly by the mold material and not by the thermoplastic material.

At the forward portion of the insole, the provision of only thermoplastic material enables that part of the insole to be matched to the shape of the foot during the first few days of wear. The setting time may be determined by provision of setting materials in appropriate proportions. A suitable thermoplastic material for use as layer 66 is distributed by Pars Medical Distributors of Kansas City, Mo., U.S.A. under the trade name Plastazote.

According to a preferred embodiment of the present invention, the foot is restrained by restraining means at the desired angle and position during the casting process. These restraining means may include mechanical means for holding the shin and/or foot, or the foot may be restrained manually.

According to an embodiment of the invention, the mold may be heated before, during or after the molding process. Heating of the mold serves to create a thick outer skin on the insole, particularly when the casting material is polyurethane, which provides reinforcement for the insole. This reinforcing step is not utilized with prior art methods of casting an insole inside a shoe.

It is a particular feature of this embodiment of the present invention that, during the foaming process, excess liquid casting material is permitted to overflow from the recess in the mold, through pressure created gaps between layer 46 and the top surface of the mold as illustrated in FIG. 4 or into overflow grooves as illustrated in FIG. 2. This prevents undue pressure from building up underneath or around the sides of the foot and causing the foot to change its orientation with respect to the mold or its shape during the molding process.

Once the foaming process is completed (typically in 2 to 10 minutes), foot 60 is removed from engagement with the mold and the cast is removed from the recess. As shown in FIG. 5, the bottom and sides of the cast bear the shape of the recess 44, while the top bears the shape of the plantar surface of the foot surrounded by unshaped material where the casting material flowed out of the recess, as at 50.

Figure 6:
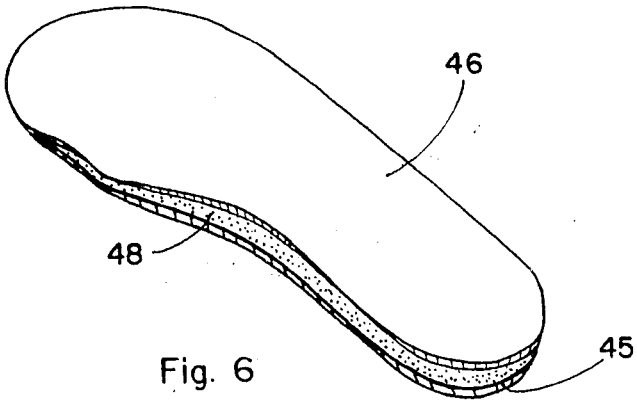

The cast is trimmed to its final size and shape, shown in FIG. 6, by removing the excess casting material about its circumference, as well as any excess insulating material extending from the finished insole. The insole is now ready to be inserted into the shoe of the patient. In order to shorten the insole fitting process, it is preferred that the recess 44 be complementary to the inner sole of the shoe into which the insole is to be inserted. Then, removal of the overflow casting material is all that is required to complete the insole. Alternatively, the insole may be tailored to conform to the shoe.

It will further be appreciated that, during the casting process, insulating layer 46 and reinforcing layer 45 become bonded to the casting material, thereby forming a single integral unit, as shown in FIG. 6.

According to a preferred embodiment of the invention, the casting material employed is polyurethane. This material comprises two chemical compositions which, when mixed together, polymerize to release a gas, thereby producing a foam. If a foot is placed in engagement with the polyurethane during the polymerization process, the pressure of the foam causes the casting material to engage the entire plantar surface of the foot, providing an insole precisely molded to the individual foot. The provision of an intermediate layer softens the surface of the insole by producing a smoother surface closely approximating the planter surface but not precisely reproducing it.

The fact that the mold utilized has an open top recess, and means to permit overflow of excess casting material, as opposed to molding the insole inside a shoe, permits the foaming casting material to flow out of the mold. Thus, controlled pressure of the casting material acts only on the plantar surface of the foot, rather than uncontrolled pressure building up all around the foot. This permits one to keep the foot in a predetermined orientation relative to the mold and to obtain the desired insole shape and height by the molding process itself.

Figure 7:
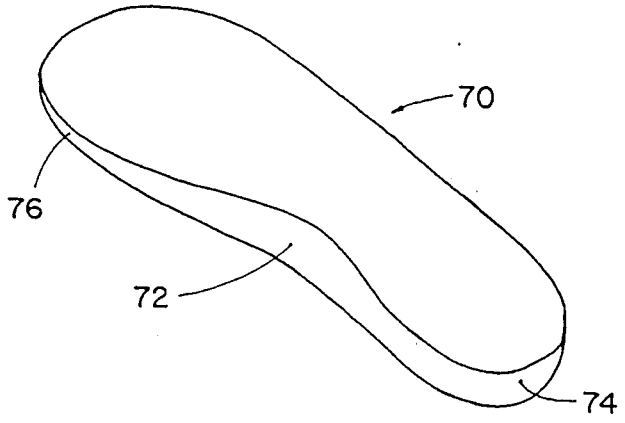
FIGS. 7, 8, 9 and 10 illustrate the steps of a method for producing an insole in accordance with an alternate embodiment of the present invention, FIG. 7 being a perspective view of an insole blank, FIG. 8 being a side sectional view of the insole blank in the mold before molding, FIG. 9 being a side sectional view during molding, and FIG. 10 being a side sectional view f the final insole.

The method of producing an insole according to an alternate embodiment of the present invention will now be described with reference to FIGS. 7, 8, 9 and 10. In FIG. 7 there is illustrated an insole blank generally designated 70 preferably shaped as a standard insole. Insole blank 70 comprises any cellular thermoplastic material which is deformable at a temperature higher than about 60° Celcius, well above the temperature existing inside the shoe, and at low pressure (i.e., less than about 1.0 atmosphere). An example of a suitable material is a thermoplastic foam, such as "Plastazote", the trademark for thermoplastic foam of Pera Medical Distributors, Kansas City, Mo., U.S.A. Alternatively, insole blank 70 may comprise any other flexible thermoplastic material.

Blank 70 defines a raised portion 72, to conform to the medial arfh of the foot, and a higher heel portion 74 than toe portion 76. Blank 70 defines the approximate shape of the recess 82 of a mold 80. Mold 80 is essentially identical to that shown in FIG. 1. This initial shape, which requires relatively slight deformation to conform to the foot, is preferred because of the limited amount of deformation which can be obtained with such thermoplastic materials by the pressure acting thereon during the deformation/molding process.

Figure 8:
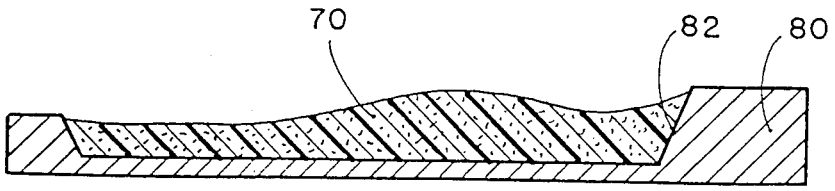
Figure 9:
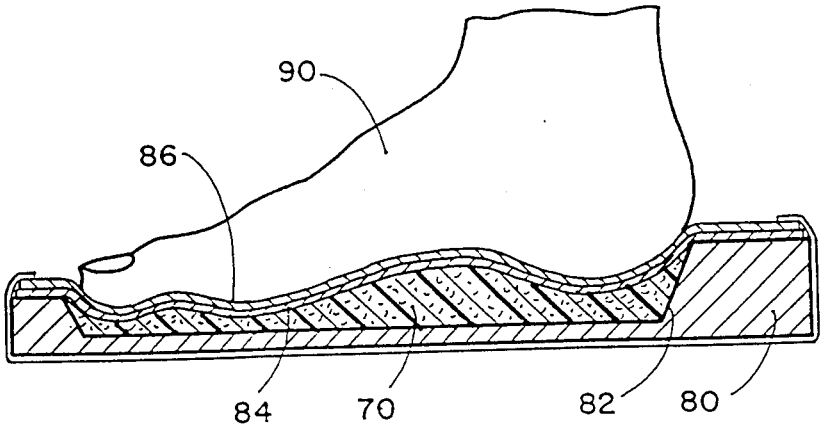

Blank 70 is preheated until it becomes plastic and deformable and placed inside recess 82, as shown in FIG. 8. Alternatively, blank 70 may be heated while within the mold, as by a hot air stream or other heating means.

Insole blank 70 may additionally be heated during molding, while the foot is pressed onto it. In the embodiment illustrated in FIG. 9, an electric sheet heater 84 is employed for heating the upper portion of the blank 70. Heating of the upper portion serves to reduce the pressure which the foot must exert in order to impress its shape on the blank so as to obtain the desired shape of the insole. Heater 84 may comprise an electrically conductive rubber sheet, or a silicone rubber/-fiberglass heater marketed by Electro-Flex Heat, Inc., Bloomfield, Conn., USA, or any other flexible heating means.

A layer of insulating material 86 is laid over insole blank 70, or heater 84, if present. Insulating layer 86 may comprise, for example, foam rubber or polyurethane foam. Alternatively, an insulating layer in the form of a sock may be worn on the foot.

Before the actual molding is begun, the foot is examined and surface contouring may be added anywhere on the foot to form local recesses in the finished insole. These recesses serve to release local pressure or load on a portion of the foot by the finished insole.

Once the heated insole blank has been placed in the recess, and insulating layer 86 placed thereover, the plantar surface of the foot is brought into engagement therewith and pressed into the recess at the desired angle and position. The foot is retained in this position for several minutes while the thermoplastic material deforms. When insole blank 70 has reached the desired shape, heating is stopped and the insole is permitted to cool while the foot is still in engagement therewith.

Engagement of the insole blank by the foot may be accomplished either by pressing the foot into engagement with the blank in the mold, or by raising the mold to press against the foot.

According to a preferred embodiment of the present invention, the foot is restrained by restraining means at the desired angle and position during the molding process. These restraining means may include mechanical means for holding the shin and/or foot, or the foot may be restrained manually.

Figure 10:
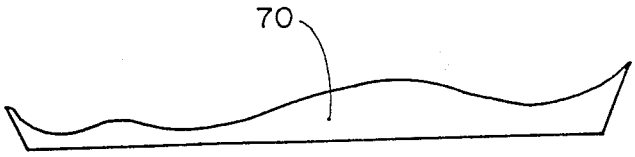

Once the thermoplastic insole 70 has cooled sufficiently so that it has regained its resiliency, the foot is removed from engagement with the mold and the insole is removed from the recess. As shown in FIG. 10, the bottom and sides of the insole bear the shape of the recess 82, while the top bears the shape of the plantar surface of the foot. The insole is now ready to be inserted into the shoe of the patient.

It is a particular feature of the present invention that the insole made according to this method can be fit into a special shoe, having an inner base complementary to recess 82. This permits the insole to sit inside the shoe with no distortion, thus conforming to the foot state during the molding process, without requiring any addition of material to the insole or extra trimming. Alternatively, when not using these special shoes, the insole may be fit into any shoe, by trimming it or by adding a layer to it, as required.

Figure 11:
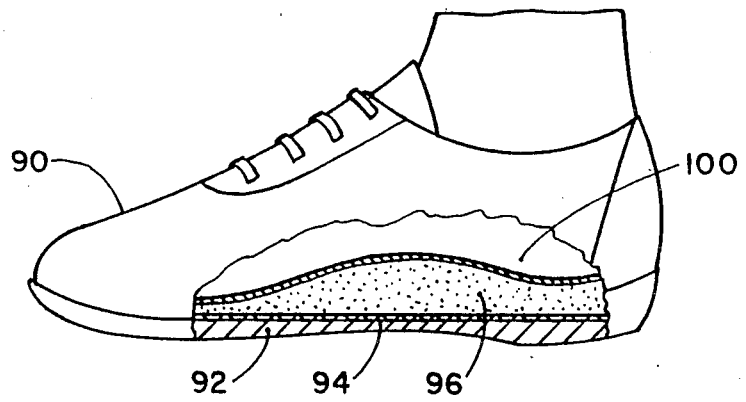
FIG. 11 is a partially cut away side view of a shoe bearing an insole constructed and operative in accordance with the present invention.

With reference to FIG. 11 there is shown a partially cut away illustration of a shoe including an insole constructed in accordance with the present invention. The shoe comprises an upper 90 and a sole 92 defining a foundation 94 complementary to the recess of the mold used to produce the insole, in this case with a flat surface. An insole 96 made according to the any of the above processes is inserted into the shoe and seated or glued onto the foundation of the sole. When the patient wears the shoe, the insole conforms to his foot 100.

It will be appreciated that the present invention is not limited to what has been described and shown hereinabove merely by way of example. Rather, the scope of the invention is limited solely by the claims which follow.

I claim:

1. A method for casting in situ an insole on a foot comprising the steps of:

providing a mold defining an open top recess, arranged to permit visual inspection of the position and orientation of the foot in the mold;

providing in said open top recess a bottom reinforcing layer of reinforcing material;

providing a hardenable, foamable material in a liquid state onto said bottom layer in the recess;

placing a layer of flexible material over the foamable material;

placing the foot within said recess such that the plantar surface of the foot lies in engagement with said layer of flexible material and over said bottom layer at a predetermined angle and position relative to the mold;

permitting the foamable material to foam and expand whereby the lower surface of the foamable material conforms to the recess and the upper surface of the foamable material conforms to the shape of the planter surface of the foot;

permitting excess foamable material to overflow from said recess through gaps between the layer of flexible material and the bottom layer, whereby undue pressure is prevented from building up underneath or around the sides of the foot which could cause the foot to change its orientation with respect to the mold or its shape during casting;

permitting the foamable material to harden;

trimming the periphery of the reinforcing layer beyond the recess and excess foamable material, thereby producing a completed composite insole wherein the layer of flexible material and the bottom layer are joined by the hardened foamable material the bottom layer defining the bottom of the insole.

2. The method of claim 1 and wherein said step of placing comprises the step of placing an intermediate layer of insulating material on the casting material.

3. The method of claim 1 and further comprising the step of restraining the foot in the predetermined angle and position relative to the mold during the step of engaging.

4. The method of claim 1 and wherein said foamable material comprises polyurethane.

5. The method according to claim 1 and further comprising the step of adding surface contouring to the foot before said step of placing.

6. The method according to claim 1 and also comprising the step of defining recesses in the base of said insole so as to permit transverse compression thereof so as to fit shoes of different sizes.

7. An insole cast according to the method of claim 1.

* * * * *